US006939254B2

(12) United States Patent
Tiefel

(10) Patent No.: US 6,939,254 B2
(45) Date of Patent: Sep. 6, 2005

(54) DIVOT REPAIR TOOL FOR GOLFERS

(76) Inventor: Hans Tiefel, Graf-Puckler-Limpurg.Str. 83a, D-90768 Furth (DE)

( * ) Notice: Subject to any disclaimer, the term of this patent is extended or adjusted under 35 U.S.C. 154(b) by 0 days.

(21) Appl. No.: 10/349,135

(22) Filed: Jan. 22, 2003

(65) Prior Publication Data

US 2005/0101416 A1 May 12, 2005

(51) Int. Cl.[7] ..... A63B 57/00
(52) U.S. Cl. ..... 473/408; 473/406
(58) Field of Search ..... 473/406, 408, 473/285, 286

(56) References Cited

U.S. PATENT DOCUMENTS 4,007,928 A * 2/1977 Doubt ..... 473/406
4,535,987 A * 8/1985 Dikoff ..... 473/406
5,054,777 A * 10/1991 Borden et al. ..... 473/406
5,226,647 A * 7/1993 Notarmuzi ..... 473/408
6,290,617 B1 * 9/2001 Cole et al. ..... 473/408
6,565,458 B1 * 5/2003 Cameron ..... 473/408

* cited by examiner

*Primary Examiner*—Steven Wong
(74) *Attorney, Agent, or Firm*—Baker Botts L.L.P.

(57) ABSTRACT

The invention relates to a divot repair tool (1) with a first base member (4), which basically creates the gripping function of the divot repair tool (1), and a second base member with at least two prongs (2) extending from the first base member (4) and which basically creates the divot repair function of the divot repair tool (1). The functions of the divot repair tool are further expanded by the fact that the second base member (4) features a recess (13) for lodging a ball marker (14). In a preferred embodiment, the recess (13) is shaped as a slot between the prongs (2), a bridge (15) being attached to the ball marker allowing to slip the ball marker (14) in the slot.

11 Claims, 5 Drawing Sheets

DIVOT REPAIR TOOL FOR GOLFERS

Figure 1:
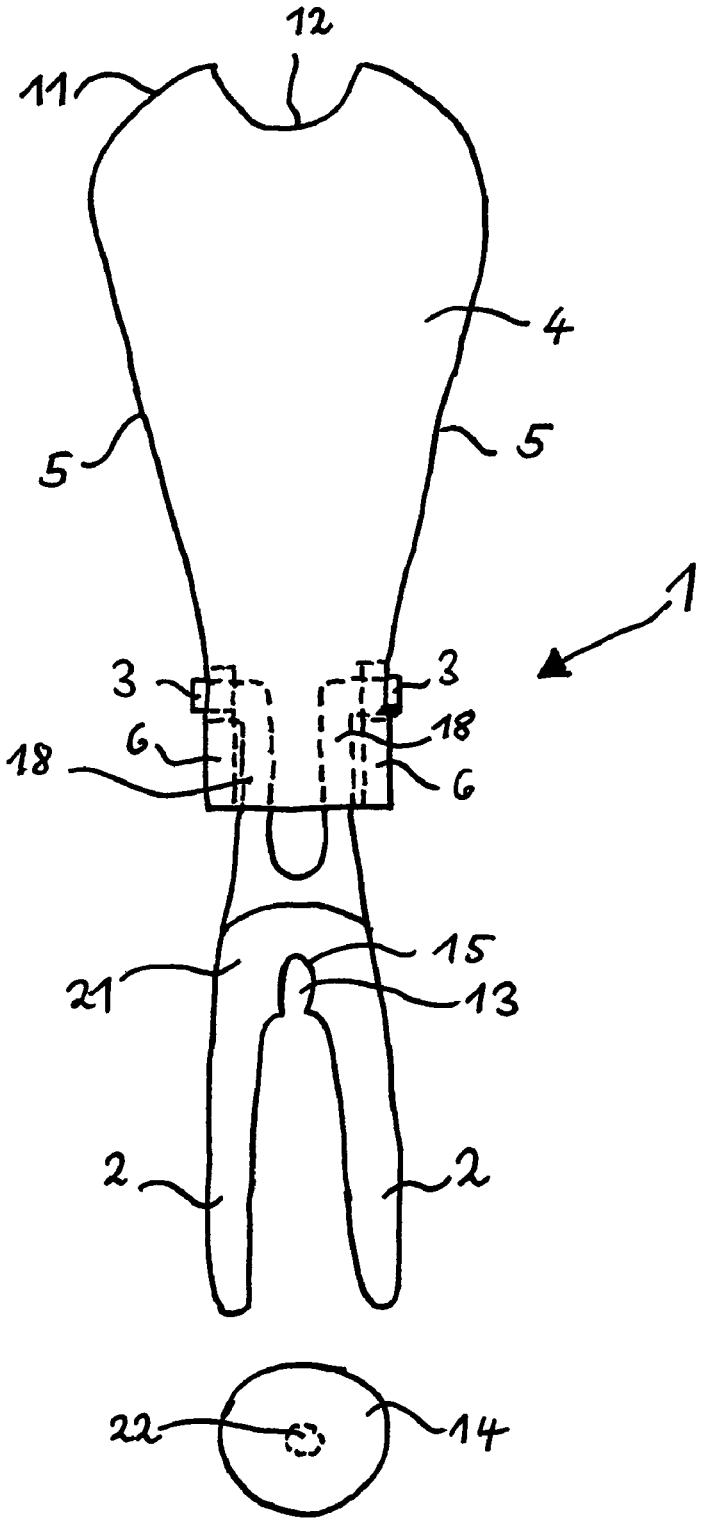

The invention concerns a divot repair tool for golfers and comprises a first base member, which basically creates the gripping function of the divot repair tool, and a second member with at least two prongs extending from the first base member, which basically creates the divot repair function of the divot repair tool.

Golfers use said divot repair tools to repair the green in the tee area of a golf ball and generally carry them with them accordingly.

Said embodiment of a divot for golf players is known from DE 200 17 471 U1, which describes a base area with at least two prongs extending therefrom, an area shaped like the concave tray of a shoehorn extending from the base area in the opposite direction from the prongs.

The object of the invention is to provide for a divot repair tool with additional functions, in particular for the game of golf.

This task is met by the divot repair tool mentioned above in that the second base member has an recess for storage of the ball marker.

Besides the regular function as a fork, the divot repair tool herewith provides in a surprisingly simply way the additional function of a seat for the ball marker needed to mark a golf ball. Hence, the divot repair tool and the ball marker create one single functional unit. Moreover, the ball marker, which otherwise gets lost easily, is securely attached to said divot repair tool, thus nearly eliminating the risk of losing such ball marker.

In an advantageous embodiment of the divot repair tool, the indentation is shaped as a slot between the prongs, with a bridge projecting from the ball marker, which allows the ball marker to be pressed into the slot. When the ball marker is not needed, it remains securely lodged in said slot of the divot repair tool, while the unrestricted divot function of said divot repair tool is maintained.

The secure lodging of the ball marker in said divot repair tool may be further improved by forming the bridge in a circular conical shape which is tapered downwards, and by forming the slot in a graduated shape, which is tapered in the direction of the prongs.

The functionality of the divot repair tool may be further expanded by a third function by shaping the first base member so that it can be used as a shoehorn.

The first and second base member of the divot repair tool are slewable, thus allowing the golfer to securely carry the divot repair tool with him and safely store it in the pockets of his pants or jacket. The pointed divot repair tool part is simply folded away so the pointed prongs of the divot repair tool will not tear (pant) pockets when being inserted or carried around. In addition, this allows for the shortest and most compact structure possible.

The folding function of the divot repair tool is provided in an advantageous way in that the first base member, at its end facing the second base member, is equipped with bridges having collateral elevations with bearing recesses's, and the second base member is equipped with collateral studs gripping into the recesses for the bearings.

A safe closed condition of the divot repair tool is ensured by the fact that the bearing recesses and the bearing protrusions are shaped in such a way that the first and the second base member are at least still slightly pressed together when the divot repair tool is in a folded position. This also allows for the practical option of simply clipping on the divot repair tool to pant, shirt or jacket pockets while playing golf, or slipping it in such pockets.

Secure transportation of said divot repair tool without the risk of getting hurt is further improved by the lower end sections of the prongs of the second base member having sloping edges, thus allowing for the said prongs to be at least slightly covered by the first base member when in a folded position. This way, the prongs of said divot repair tool are "disarmed" and the golfer cannot be hurt or get his or her clothes damaged when carrying said divot repair tool or when falling.

A fourth functionality of the divot repair tool can be realized by equipping the first base member at its end with a primarily semicircular cavity providing a rest for a golf club handle when the prongs of the divot repair tool are inserted in the soil. Said embodiment makes it possible to insert the prongs into the ground and rest the golf club on said cavity, thus keeping the handle from coming into contact with wet grass, for example.

Both said divot repair tool and said ball marker are preferably constructed from plastic or metal. The material characteristics of plastic offer the advantage of a lightweight divot repair tool structure on one side, and make it easier to create the folding mechanism of the divot repair tool's two base members on the other side.

Coating the divot repair tool with a metallic finish creates a particularly valuable optical appearance.

In the following, the invention is described in further detail by way of example of the embodiment shown in the Figures.

Figure 2:
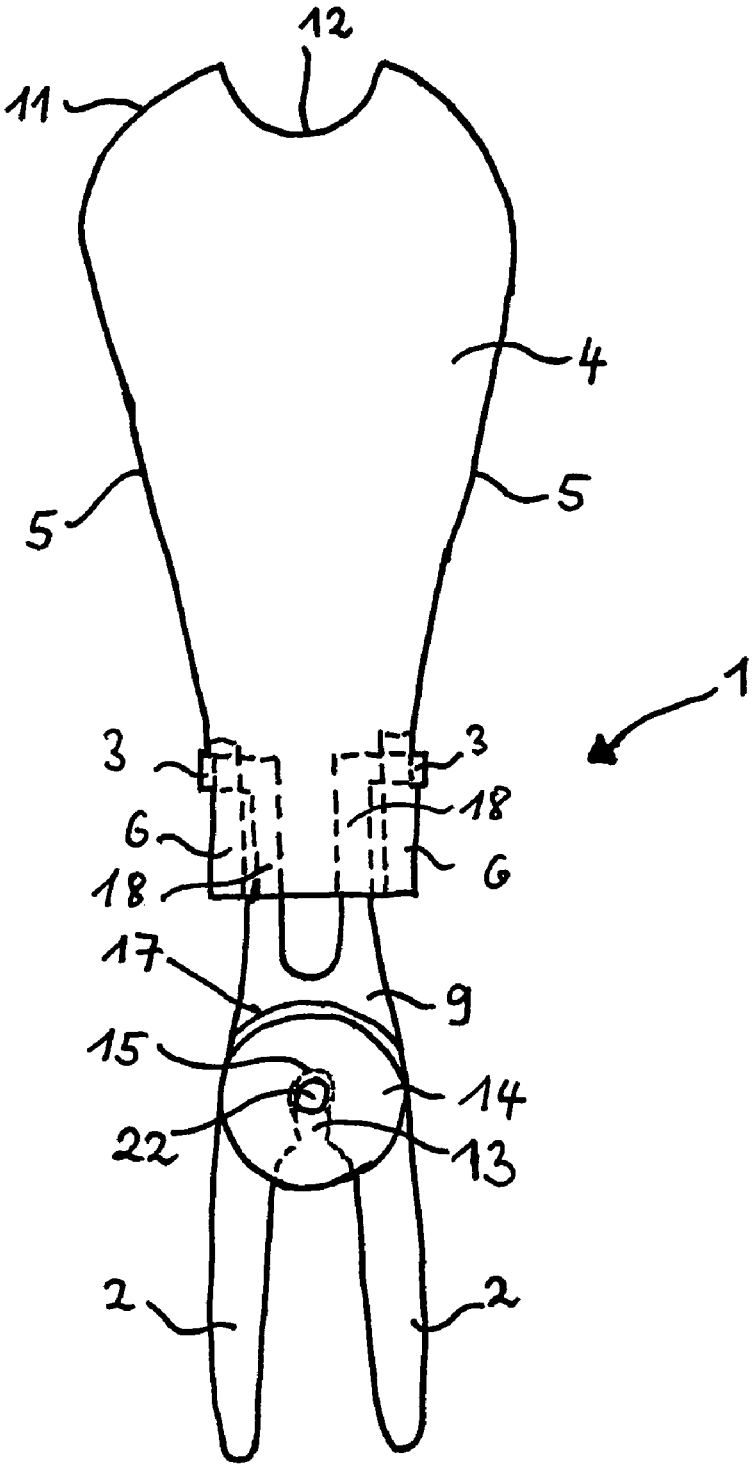
Figure 3:
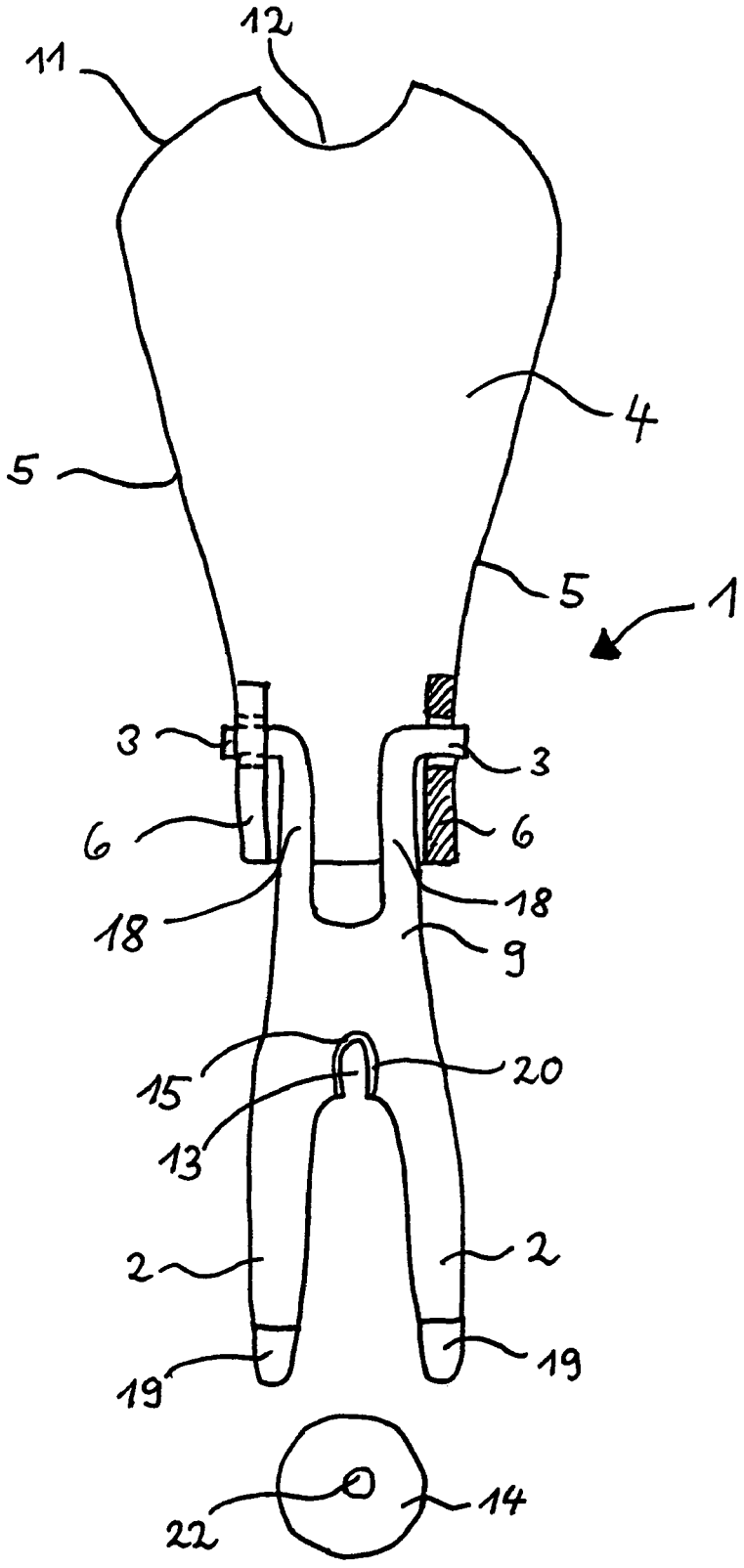
Figure 4:
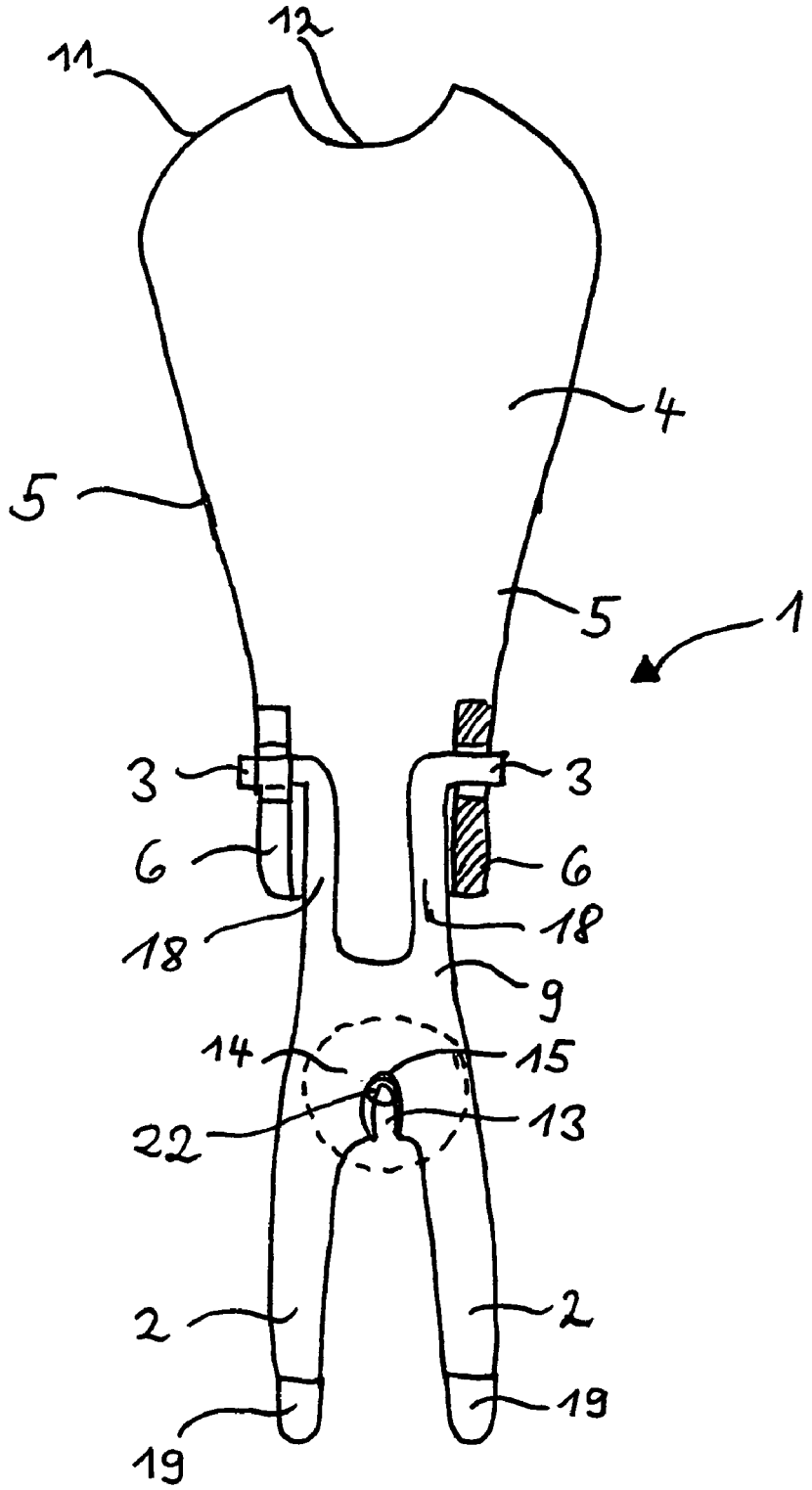
Figure 5:
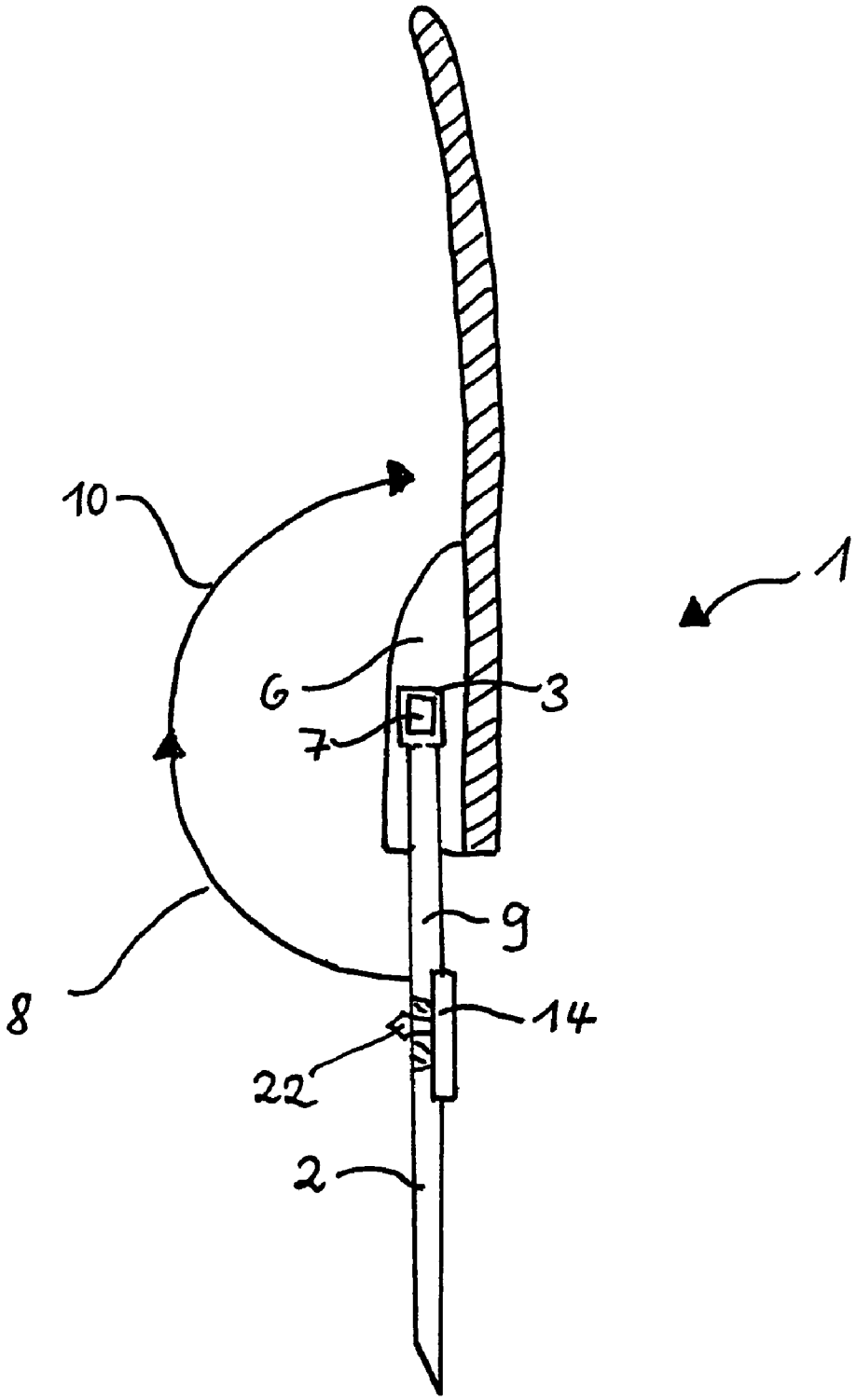

FIG. 1 is a top view of a divot repair tool with a ball marker seat and the ball marker removed, FIG. 2 is a top view of a divot repair tool with a ball marker seat and the ball marker secured atop said divot repair tool, FIG. 3 is a rear view of the divot repair tool and ball marker seat as illustrated in FIG. 1 with said ball marker removed, FIG. 4 is a view of the divot repair tool illustrated in FIG. 3 with the ball marker secured on said divot repair tool, FIG. 5 is a side view of the divot repair tool with a ball marker seat as illustrated in FIGS. 1–4.

FIG. 1 shows a divot repair tool 1 from a first side, in particular from the top. The divot repair tool 1 basically comprises a first base member 4 shaped as a shoehorn, and a second base member 9 with a pair of (divot) prongs 2 extending from the front part thereof. There is a slot-shaped indentation 13 between the divot prongs 2 in which a bridge 15 of a ball marker 14 may be inserted in the direction of the arrow 16. The second base member 9 is equipped with a ball marker seat 21 delimited by a curvature 17 on the side facing the first base member 4. The surface of said ball marker seat 21 is delimited from the rest of the second base member 9 by a curvature 17. The ball marker seat 21 is graduated in respect of the other area of the second base member 9 delimited by curvature 17. The second base member 9 has a pair of bearing legs 18 at the end facing away from the prongs, which both comprise protrusions 3 laterally attached in tangent-bent shape. The first base member 4 presents a shoehorn tray with the basic tear-shape of a shoehorn, the area of the outer edges 5 of the first base member 4 facing the second base member 9 being provided with a collaterally raised area 6 or spindle 6 with bearing recesses 7 (see FIG. 5). The lateral protrusions 3 of the second base member are snapped in these bearing recesses under formation of a drag bearing. The uncovered extremity 11 of the shoehorn tray 4 presents a semicircular cavity 12. This makes it possible to rest the golf club atop of it when the prongs 2 are being inserted into the ground, thus keeping the golf club from coming in contact with the possibly wet ground.

The divot repair tool illustrated in FIG. 1 stands out by the combination of two basic functions, i.e., "divot repair tool" and "ball marker seat." Consequently, the divot repair tool and the ball marker 14 create one unit, allowing for secure lodging of the ball marker 14. The ball marker 14 may be easily slipped into the divot repair tool 1 illustrated by the embodiment shown in FIG. 1 by simply putting said ball marker 14 on the prongs 2 and pressing it in the direction of the arrow 16 with your thumb, for example. To this purpose, a bridge 22 is attached to one side of the ball marker 14, such bridge having a circular conical shape which is tapered downwards, allowing for secure lodging of the ball marker 14 in the slot 13, which is graduated and slightly tapered in the direction of the prongs 2. Furthermore, the ball marker 14 may be easily and single-handedly removed from said divot repair tool 1 by applying outward pressure on the ball marker from the ball marker seat 21 in the direction of the prongs 2. Besides these basic functions, the divot repair tool shown in FIG. 1 also illustrates the functions of a "shoehorn" and a "golf club support" and therefore presents a universally applicable golf device.

FIG. 2 is a top view of a divot repair tool 1 with a ball marker 14 secured atop said divot repair tool. Here, the same reference numbers already explained in connection with FIG. 1 are used, so that the corresponding description is being referred to for clarification.

FIG. 3 is a rear view of the divot repair tool and ball marker shown in FIG. 1 with the ball marker 14 removed, with the difference that said divot repair tool illustrated in FIG. 3 shows a divot repair tool with a ball marker 14 secured atop the divot repair tool. With the ball marker 14 removed, FIG. 3 clearly illustrates the graduated shape, i.e., recess step 20, of the recess 13. The recess step 20 allows for the cone of the bridge 22 of the ball marker to be grasped from behind after being inserted, and the ball marker 14 to be securely lodged in the slot 13. Furthermore, FIG. 3 shows that the bottom of the prongs 2 of the divot repair tool 1 have slant ends 19. This secures that the prongs 2 rest completely on the surface of the first base member 4 or are nearly completely enclosed, respectively, by the shoehorn when the divot repair tool 1 is folded together. This way, any risk of getting hurt by the folded divot repair tool or damaging clothes when picking up the same is being avoided.

FIG. 5 is a side view of the divot repair tool 1 with the ball marker seat as shown in FIGS. 1–4. FIG. 5 clearly illustrates the embodiment of the ball marker 14 with a ball marker bridge 22, as explained in FIGS. 1 and 2. The bridge 22, which is depicted longer than its real size for a better illustration, is attached to the ball marker 14 and shaped as a circular cone, which is tapered downwards. This allows for the ball marker 14 to be securely lodged in the slot 13, which is graduated and slightly tapered in the direction of the prongs 2.

The height of the bearing recess 7 perpendicular to the longitudinal surface of the entire device is slightly larger than the extension of the lateral protrusions 3 viewed in this direction, resulting in secure final positions when folded up or folded together in the direction of the arrows 8, 10 or the opposite direction thereof. A secured closed position of the divot repair tool is guaranteed by the fact that the bearing recesses 7 and the bearing protrusions 3 are shaped in such a way that the first 4 and second 9 base member are still at least slightly pressed against one another when the divot repair tool 1 is in a folded position. This also results in the practical option of slipping or clipping on the divot repair tool 1 to pant, shirt or jacket pockets while playing golf.

In summary, the invention therefore concerns a divot repair tool with a first base member, which basically creates the gripping function of the divot repair tool, and a second base member with at least two prongs extending from said first base member, thus basically creating the divot function of said divot repair tool. Additional functions of the divot repair tool consist of an recess in the second base member allowing to lodge the ball marker. This recess is preferably shaped as a slot located between the prongs, a bridge being attached to the ball marker enabling the ball marker to be slipped into the slot.

What is claimed is:

1. A divot repair tool comprising:

a first base member having a gripping function, and a second base member comprising two prongs extending from the first base member for providing a divot repair function, wherein the second base member further comprises a recess for lodging a ball marker, the first base member is shaped like a shoehorn, the end of the first base member presents a semicircular recess allowing to rest a golf club atop of it when the prongs of said divot repair tool are inserted in a soil, and the first and the second base member of said divot repair tool are in a slewable position towards one another, wherein the recess is shaped as a slot located between the prongs and wherein a bridge is attached to the ball marker to allow for slipping the ball marker into said slot, and wherein the bridge is shaped as a circular cone, which is tapered downwards, and wherein the slot is graduated and tapered in the direction of the prongs.

2. A divot repair tool according to claim 1, wherein the first base member comprises bridges with bearing recesses in the area facing the second base member and that the sides of the second base member have lateral protrusions gripping into the bearing recesses.

3. A divot repair tool according to claim 2, wherein the bearing recesses and the lateral protrusions are shaped in such a way that the first and the second base member are at least still slightly pressed together when said divot repair tool is folded up.

4. A divot repair tool according to claim 1, wherein the prongs of the second base member have slant front ends, allowing for the prongs to be at least slightly covered by the first base member when said divot repair tool is folded up.

5. A divot repair tool according to claim 1, wherein said divot repair tool and said ball marker are constructed from plastic or metal.

6. A divot repair tool according to claim 1, wherein said divot repair tool is coated with a metallic finish.

7. A divot repair tool comprising:

a first base member having a gripping function, and a second base member comprising two prongs extending from the first base member for providing a divot repair function, wherein the second base member further comprises a recess for lodging a ball marker, the first base member is shaped like a shoehorn, the end of the first base member presents a semicircular recess allowing to rest a golf club atop of it when the prongs of said divot repair tool are inserted in a soil, the first and the second base member of said divot repair tool are in a slewable position towards one another, and wherein the prongs of the second base member have slant front ends, allowing for the prongs to be at least slightly covered by the first base member when said divot repair tool is folded up, wherein the recess is shaped as a slot located between the prongs and wherein a bridge is attached to the ball marker to allow for slipping the ball marker into said slot, and wherein the bridge is shaped as a circular cone, which is tapered downwards, and wherein the slot is graduated and tapered in the direction of the prongs.

8. A divot repair tool according to claim 7, wherein the first base member comprises bridges with bearing recesses in the area facing the second base member and that the sides of the second base member have lateral protrusions gripping into the bearing recesses.

9. A divot repair tool according to claim 8, wherein the bearing recesses and the lateral protrusions are shaped in such a way that the first and the second base member are at least still slightly pressed together when said divot repair tool is folded up.

10. A divot repair tool according to claim 7, wherein said divot repair tool and said ball marker are constructed from plastic or metal.

11. A divot repair tool according to claim 7, wherein said divot repair tool is coated with a metallic finish.

* * * * *